United States Patent [19]

James et al.

[11] 4,279,116

[45] Jul. 21, 1981

[54] METHOD OF AND APPARATUS FOR WRAPPING

[75] Inventors: Robert C. James; Dennis P. Horsman; Richard D. Sorenson, all of Sheboygan, Wis.

[73] Assignee: Hayssen Manufacturing Company, Sheboygan, Wis.

[21] Appl. No.: 36,175

[22] Filed: May 4, 1979

[51] Int. Cl.[3] ..... B65B 11/22

[52] U.S. Cl. ..... 53/466; 53/232

[58] Field of Search ..... 53/466, 228, 229, 230, 53/231, 232, 233, 234

[56] References Cited

U.S. PATENT DOCUMENTS

| | | | |
|---|---|---|---|
| 2,146,997 | 2/1939 | Smith | 53/230 |
| 3,006,119 | 10/1961 | Fingerhut | 53/230 X |
| 3,212,230 | 10/1965 | Coates | 53/228 |
| 3,507,091 | 4/1970 | Mizelle | 53/230 X |
| 3,857,221 | 12/1974 | Schmermund | 53/234 |
| 3,861,120 | 1/1975 | Gordon | 53/230 |
| 4,035,990 | 7/1977 | Hallam | 53/228 X |
| 4,078,363 | 3/1978 | Panzi | 53/228 |
| 4,083,165 | 4/1978 | Maldina | 53/234 X |
| 4,137,691 | 2/1979 | Takahashi | 53/230 X |

FOREIGN PATENT DOCUMENTS

| | | | |
|---|---|---|---|
| 2746431 | 4/1979 | Fed. Rep. of Germany | 53/229 |
| 2810586 | 9/1979 | Fed. Rep. of Germany | 53/234 |
| 283611 | 10/1952 | Switzerland | 53/233 |

*Primary Examiner*—John Sipos

*Attorney, Agent, or Firm*—Senniger, Powers, Leavitt and Roedel

[57] ABSTRACT

Method of and apparatus for wrapping reams of paper or the like in which the ream being wrapped is placed on an elevator mechanism at a lower level and raised by the elevator mechanism to an upper level. The elevator mechanism comprises a central support and two outboard supports extending endwise of the ream. The outboard supports are movable inwardly from an outer position wherein they are spaced outwardly from the central support. The outboard supports occupy their outer position as the ream is placed on the supports and while the ream is being raised. As the ream is raised, it engages a wrapper sheet and portions of the wrapper sheet fold down on the sides of the ream. When the ream is raised, underfolders move in under the ream from opposite sides of the ream to fold portions of the sheet in under the bottom of the ream. The outboard supports move inwardly toward the central support to clear the way for the underfolders to move in, and are then returned to the lower level and moved out to their outboard position. The central support is moved down to the lower level and the underfolders move into the region vacated by the central support. The ream is then pushed off the underfolders and the latter are retracted. As the ream is pushed forward, the ends of the wrapper sheet are tucked in on the ends of the ream by moving a pair of rearward tuckers forward from a retracted position and by moving the ream past a pair of fixed forward tuckers. The rearward tuckers are moved outwardly away from the ends of the ream as they return to retracted position to a position clear of the next ream being raised.

15 Claims, 23 Drawing Figures

METHOD OF AND APPARATUS FOR WRAPPING

BACKGROUND OF THE INVENTION

This invention relates to a method of and apparatus for wrapping units to be wrapped, and more particularly to a method of and apparatus for wrapping units such as reams of paper each in a wrapper constituted by a sheet of wrapping material such as paper.

The invention has been especially developed for wrapping reams of paper, and particularly reams of paper such as are supplied for use in copying machines, in a wrapper constituted by a sheet of paper or other suitable wrapping material. It will be understood that a ream generally comprises a stack of five hundred sheets of the paper, the sheets being $8\frac{1}{2}'' \times 11''$ or $8\frac{1}{2}''$ by $14''$ sheets, for example.

The invention is generally in the same field as the method and apparatus disclosed in the coassigned U.S. Pat. No. 3,861,120 issued Jan. 21, 1975, entitled Wrapping Apparatus and may be regarded as involving improvements thereover.

Wrapping such reams of paper and especially wrapping them at a relatively high production rate (e.g., 80–90 per minute) presents special problems due to the difficulty in maintaining the integrity of the ream (i.e., maintaining the ream with all the sheets in register) and due in many instances to the flexibility of the ream as a whole and the resultant tendency of the ream to sag during the wrapping operation, with resultant distortion of the wrapped package. Also, it has not heretofore been practical, particularly with the apparatus shown in U.S. Pat. No. 3,861,120, to produce wrapped reams with the bottom seam of the wrapper extending endwise of the ream in a generally centralized position between the sides of the ream, as is desirable, rather than being closely adjacent one side of the ream. Also, for high speed wrapping, it is desirable to start each wrapping cycle (the cycle of operations involved in wrapping one ream) before the preceding cycle has been completed, and this has heretofore presented a problem.

SUMMARY OF THE INVENTION

Among the several objects of the invention may be noted the provision of an improved method of and apparatus especially for wrapping reams of paper, although quite suitable for wrapping other units to be wrapped, at a relatively high production rate without losing the integrity of the ream; the provision of such a method and apparatus for maintaining total support of the longitudinal edges each ream during the wrapping operation so as to avoid sagging of the ream thus to avoid production of distorted packages; the provision of such a method and apparatus adapted for the production of wrapped reams with the bottom seam of the wrapper extending endwise of the ream in a generally centralized position between the sides of the ream, as is desirable, rather than being relatively closely adjacent one side of the ream; and the provision of such a method and apparatus enabling starting each wrapping cycle before the preceding cycle has been completed, for high speed wrapping.

In general, the invention involves a method and apparatus wherein a unit, such as a ream of paper, having a rectangular top and bottom, rectangular sides and rectangular ends, is supported at its bottom and particularly at its longitudinal edges on a central support and two outboard supports, these supports extending endwise of the unit and initially being at a lower level. The outboard supports initially occupy an outboard or expanded position spaced outwardly from the central support on opposite sides of the latter, the three supports all being generally flush one with another. The outboard supports have outboard edges which, when the outboard supports are in their expanded position, are spaced a distance corresponding to the width of the unit (the distance between the sides of the unit) so that these edges are generally in the planes of the sides of the unit. One side of the unit may be referred to as the rearward side, the other as the forward side, and the respective outboard supports may be referred to as the rearward and forward supports. A wrapper for the unit is positioned above the unit, the wrapper comprising a sheet of suitable wrapping material, e.g., paper, larger than the top of the unit and having rearward and forward portions extending beyond the planes of the rearward and forward sides of the unit a sufficient distance for being folded down upon the rearward and forward sides of the unit and under the bottom of the unit with an overlap. The three supports, generally flush one with another and with the ream thereon, are raised in unison from the lower level to an upper level, raising the ream up to the upper level. As the ream is raised, the stated rearward and forward portions of the wrapper are caused to fold down on the rearward and forward sides of the unit. With the unit at the upper level, a rearward underfolder is moved forward under the bottom of the unit from a rearward retracted position adjacent the rearward side of the unit, and a forward underfolder is moved rearward under the bottom of the unit from a forward retracted position adjacent the forward side of the unit. During the movement of the underfolders in under the bottom of the unit, the outboard supports are moved inwardly away from their expanded position toward the central support to clear the way for the underfolders. Thus, the folded-down rearward and forward portions of the wrapper are folded under the bottom of the unit, the latter being supported at its bottom toward its sides by the underfolders moving in under the bottom of the unit. The outboard supports are moved inwardly to a contracted position, then lowered back down to the lower level and returned to their expanded position. As the outboard supports are lowered, the underfolders continue their inward movement into the regions vacated by the outboard supports for the underfolding of the wrapper under the unit and the support of the unit by the underfolders. The central support is lowered back down to the lower level, the unit with the wrapper wrapped therearound is moved forward off the underfolders, and the latter are returned to their retracted position for the next cycle.

Other objecrs and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Referring to FIGS. 1–12 of the drawings, there is generally indicated at 1 a unit to be wrapped, more particularly a ream of paper, e.g., 500 sheets of $8\frac{1}{2}'' \times 14''$ copying paper such as xerography paper. This has a rectangular top 3 and a rectangular bottom 5 (each measuring $8\frac{1}{2}'' \times 14''$, for example), rectangular sides 7 and 9 (each measuring $14'' \times 2\frac{1}{8}''$, for example) and rectangular ends 11 (each measuring $8\frac{1}{2}'' \times 2\frac{1}{8}''$, for example). Sides 7 and 9 may hereinafter be specifically referred to as the rearward and forward sides of the ream, for reasons that will appear.

Figure 1:
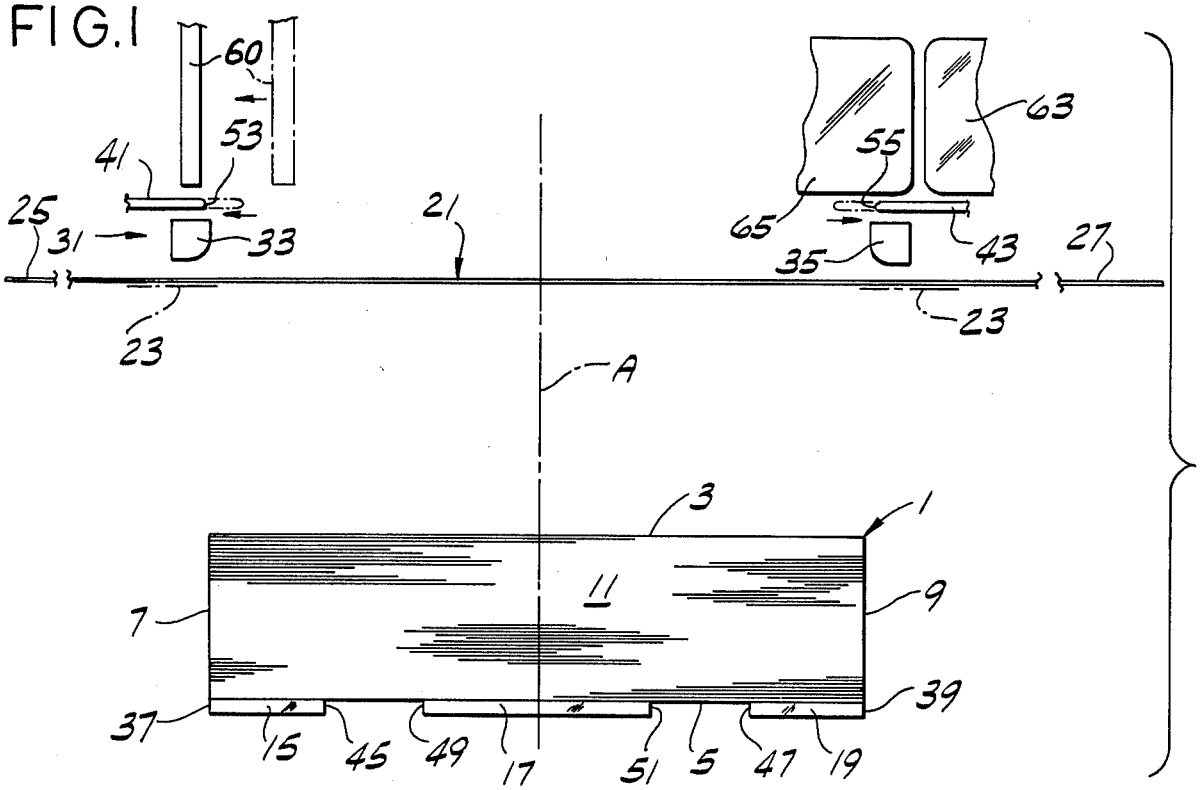
FIGS. 1–12 are diagrammatic views, in side elevation with respect to the apparatus of the invention and in end elevation with respect to a ream being wrapped, showing various phases in the sequence of operations of wrapping a ream.
Figure 16:
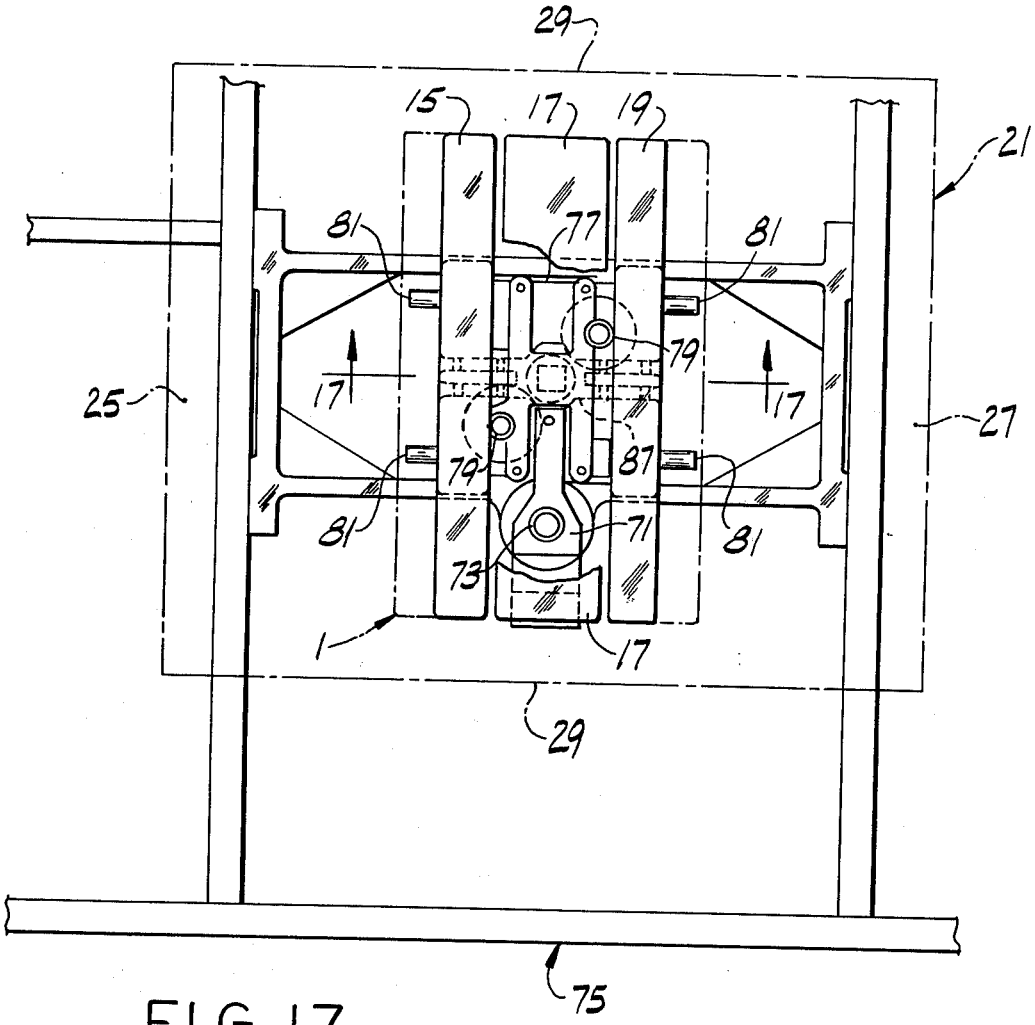
FIG. 16 is a plan of FIG. 14 with parts broken away.
Figure 17:
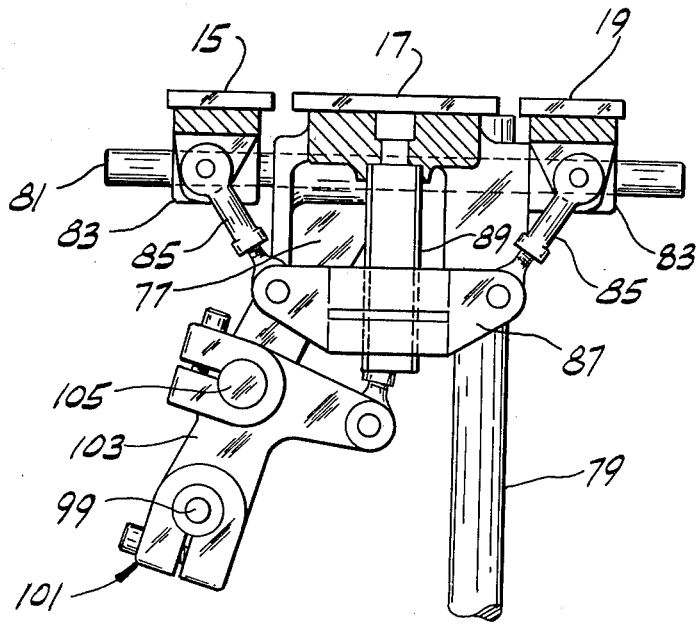
FIG. 17 is an enlarged vertical section on line 17—17 of FIG. 16.

Referring to FIG. 1 of the drawings, the ream 1 is shown as being placed on three supports or sections 15, 17 and 19 of an elevator mechanism designated in its entirety by the reference numeral 20, the ream being thereby supported at its bottom 5 on the three supports, which extend endwise of the ream. The support 17 supports the central section of the ream and is referred to as the central support. The supports 15 and 19, which are on opposite sides of the central support, are referred to as the outer or outboard supports. The central endwise vertical plane of the ream (as it is placed on the lowered supports), which constitutes a reference plane, is indicated at A. At the start of a wrapping cycle, the three supports are down at a lower level in the lower position in which they appear in FIG. 1. Here the ream is below the level at which a wrapper 21 is initially positioned for being wrapped around the ream. The wrapper 21 comprises a sheet of suitable wrapping material, which may be relatively stiff paper for example, the sheet being rectangular and larger all around than the rectangular top 3 of the ream. The wrapper is delivered to and held in the stated position for being wrapped around the ream by means indicated at 23 of suitable type well known in the art. The wrapper has rearward and forward portions 25 and 27 extending rearward and forward beyond the vertical planes of the rearward and forward sides 7 and 9 of the ream a sufficient distance for being folded down upon the rearward and forward sides 7 and 9 of the ream and under the bottom 5 of the ream with an overlap. It also has end portions each designated 29 (see FIG. 16) extending beyond the vertical planes of the ends of the ream for being folded on the ends of the ream. The wrapper 21, when in its stated wrapping position, lies below means indicated generally at 31 for folding down the rearward and forward portions 25 and 27 of the wrapper upon raising the supports 15, 17, 19 to raise the ream from the lower level or position shown in FIG. 1 to the upper level or raised position shown in FIG. 4. Means 31 generally comprises a pair of folding bars 33 and 35 positioned just above the level of the wrapper and just outward of the vertical planes of the sides 7 and 9 of the ream.

The outboard supports 15 and 19 initially occupy an outboard or expanded position spaced laterally outwardly from the central support 17 on opposite sides of the latter, the three supports all being generally flush one with another (see FIG. 1). The outboard supports 15 and 19 have outboard (outside) edges 37 and 39 which, when these supports are in their expanded position, are spaced a distance corresponding to the width of the ream (e.g., $8\frac{1}{2}''$) so that these edges are generally in the vertical planes of the sides 7 and 9 of the ream. This provides for support of the ream out to the sides of the ream. The outboard supports 15 and 19 are movable inwardly away from their expanded position toward the central support 17 (15 moves forward, i.e., toward the right, 19 moves rearward, i.e., toward the left). The three supports extend the full length of the ream for full-length support of the ream (see FIG. 16).

Figure 2:
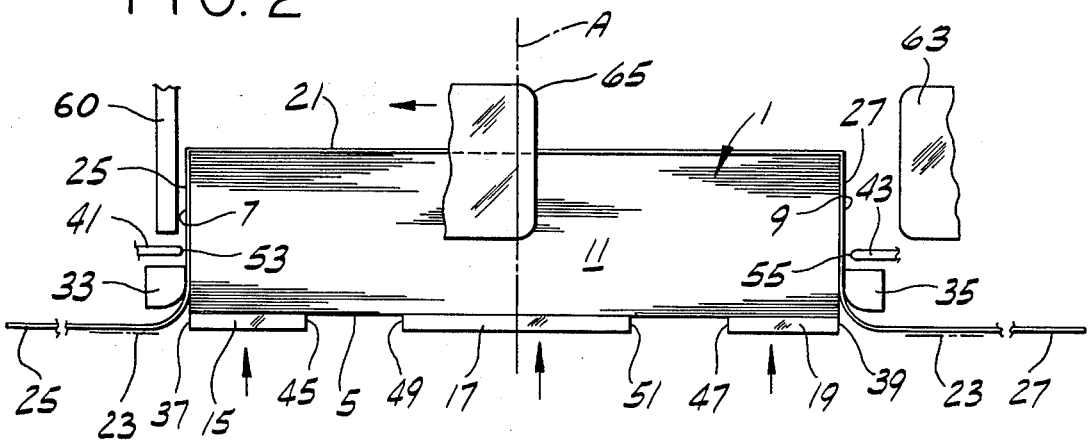
Figure 3:
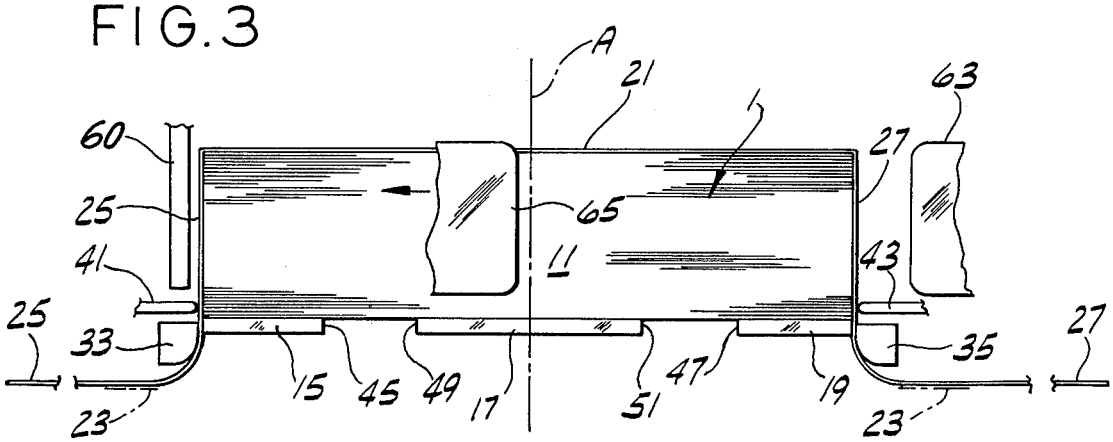
Figure 4:
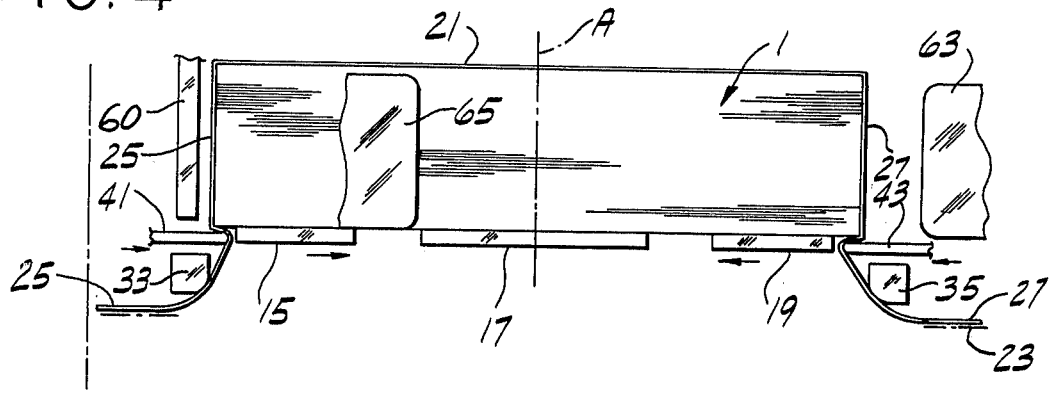
Figure 5:
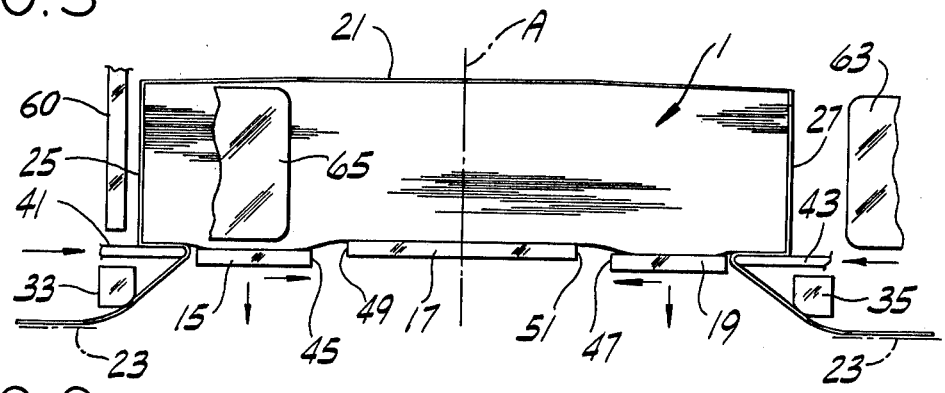
Figure 6:
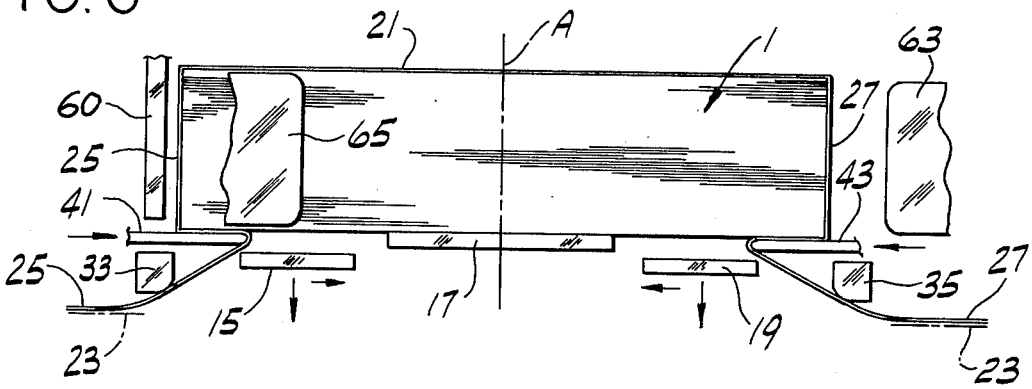

With the ream 1 in place on the three supports 15, 17 and 19, and with the wrapper 21 positioned above the ream, the three supports (generally flush one with another) are raised in unison to lift the ream from the lower position shown in FIG. 1 to the upper position shown in FIG. 4. As the ream is raised, the rearward and forward portiions 25 and 27 of the wrapper 21 are caused to fold down on the rearward and forward sides 7 and 9 of the ream by the rearward and forward folding bars 33 and 35, the ream passing upwardly between these bars as illustrated in FIGs. 2 and 3. In its raised position at the upper level, the ream lies above the horizontal plane of the top of the folding bars 33 and 35 with its bottom 5 slightly above the top surfaces of a rearward underfolder 41 and a forward underfolder 43 (see FIG. 3). Somewhat before the ream reaches the raised position, the rearward underfolder 41 starts moving forward under the bottom 5 of the ream from the rearward retracted position of the rearward underfolder adjacent the rearward side 7 of the ream shown in FIG. 2, and the forward underfolder 43 starts moving rearward under the bottom of the ream from the forward retracted position adjacent the forward side 9 of the ream shown in FIG. 2. FIG. 3 shows the underfolders having started their movement, and FIG. 4 shows the underfolders starting to fold portions 25 and 27 of the wrapper in under the bottom of the ream. During the movement of the underfolders in under the bottom of the ream, the outboard supports 15 and 19 are moved inwardly away from their expanded position of FIGS. 1–3 toward the central support 17 to clear the way for the underfoldrs. This contraction of the outboard supports is illustrated in FIGS. 4 and 5. Thus, the folded-down rearward and forward portions 25 and 27 of the wrapper are folded under the bottom of the ream, the latter being supported at its bottom toward its sides by the underfolders moving in under the bottom of the ream (the underfolders taking over the support of the ream from the outboard supports 15 and 19). The outboard supports are moved inwardly to the contracted position generally as shown in FIG. 5 wherein the inside edges 45 and 47 of the outboard supports are adjacent the side edges 49 and 51 of the central support 17, and are then lowered back down to the lower level and returned (expanded) back to their expanded position of FIG. 1 for the reception of the next ream to be wrapped. As the outboard supports 15 and 19 contract, the underfolders 41 and 43 continue their inward movement into the regions or spaces vacated by the outboard supports, the underfolders sliding in under the bottom of the ream above the contracted outboard supports as appears in FIGS. 6 and 7 for the underfolding of wrapper under the ream and for the support of the ream by the underfolders.

Figure 7:
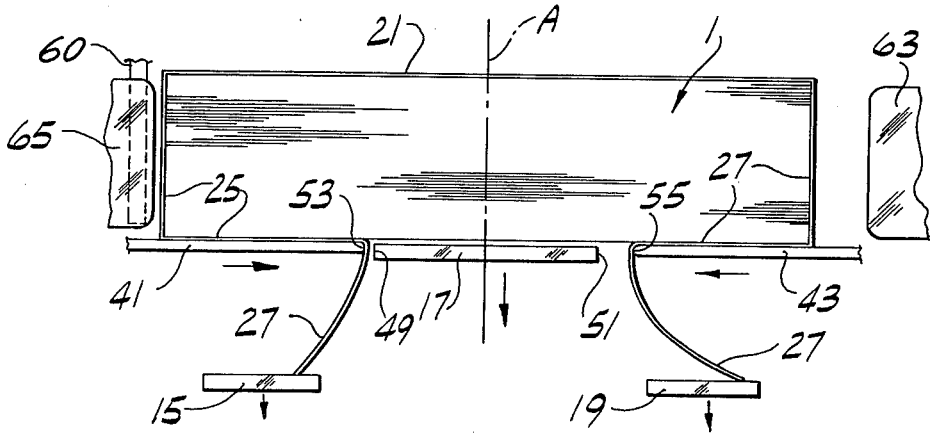
Figure 8:
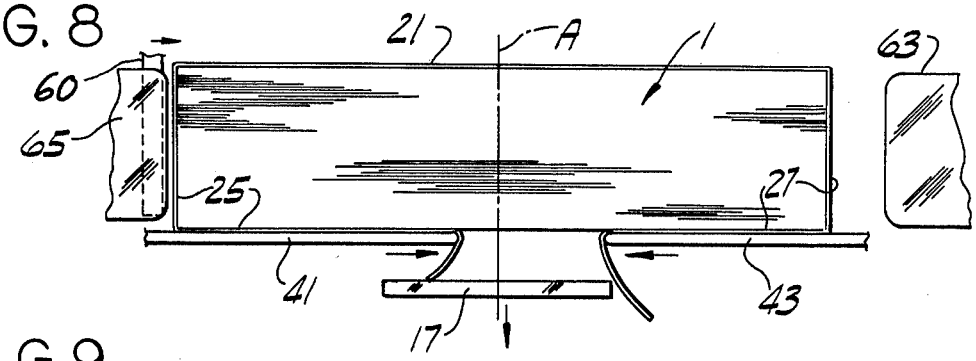
Figure 9:
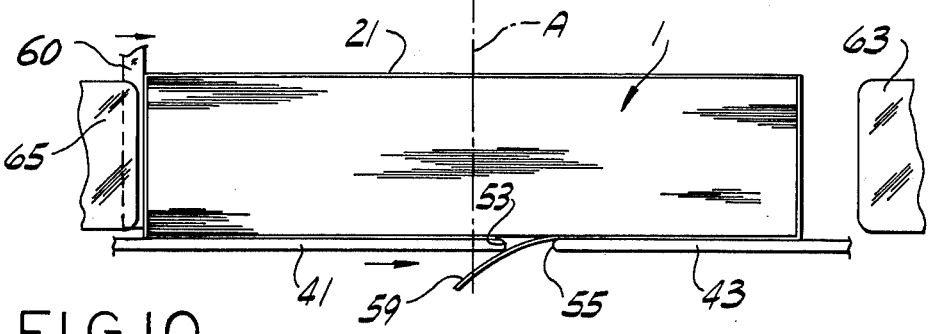
Figure 10:
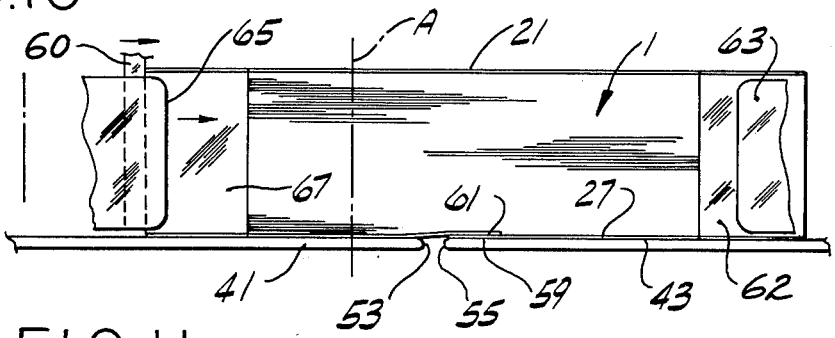
Figure 11:
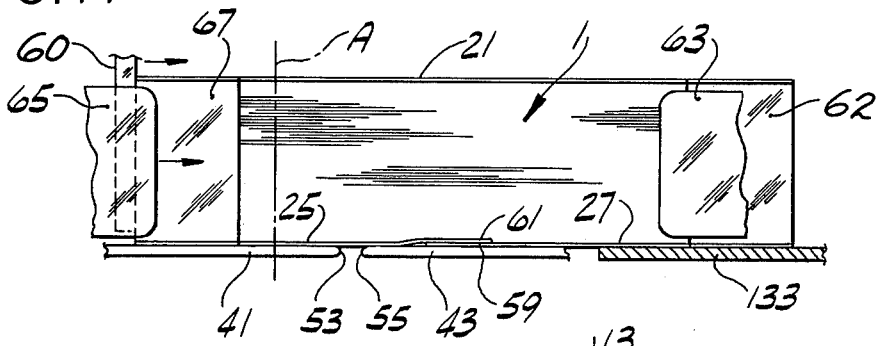

When the underfolders 41 and 43, in moving inwardly, reach the position shown in FIG. 7 wherein the forward edge 53 of the rearward underfolder 41 is adjacent the rearward edge 49 of the central support 17 and the rearward edge 55 of the forward underfolder 43 is adjacent the forward edge 51 of the central support 17 (see FIG. 7) the central support is started down and lowered back down to the lower position of FIG. 1. The underfolders continue their inward movement into the region or space vacated by the central support (see FIG. 8), the forward underfolder 43 being moved inwardly (rearwardly) under the ream a lesser distance than the rearward underfolder 41 is moved inwardly (forward) under the ream. The inward movement of the forward underfolder ceases when it reaches the position in which it is shown in FIGS. 9–11 wherein its rearward edge 55 is somewhat forward (toward the right) of the reference plane A, and the inward movement of the rearward underfolder 41 ceases when it reaches the position in which it is shown in FIGS. 10 and 11 wherein its forward edge 53 is adjacent the rearward edge 55 of the forward underfolder 43 and somewhat forward of the reference plane A.

Thus, the underfolders 41 and 43 take over the support of the ream relinquished by the central support 17. As forward underfolder 43 is moved inwardly (rearwardly) under the ream a lesser distance than the rearward underfolder 41 is moved inwardly (forwardly) under the ream, a margin 59 (see FIG. 9) of the stated forward portion 27 of the wrapper sheet (now wrapped under the bottom of the ream) projects rearwardly beyond the inner (rearward) edge 55 of the forward underfolder and down between the now adjacent inner edges of the underfolders (i.e., between the rearward edge 55 of the forward underfolder 43 and the forward edge 53 of the rearward underfolder 41).

The ream 1 with the wrapper thereon, supported by the underfolders 41 and 43, is then moved forward off the underfolders by means comprising a pusher 60 engageable with the rearward side of the ream and movable forward to push the ream forward (i.e., to slide it forward) on the underfolders. As the ream is pushed forward, the stated margin 59 of the portion 27 of the wrapper sheet is caused to lap the margin 61 of portion 25 of the wrapper sheet which was folded in under the bottom of the ream by the rearward underfolder 41 (see FIGS. 10 and 11).

Figure 12:
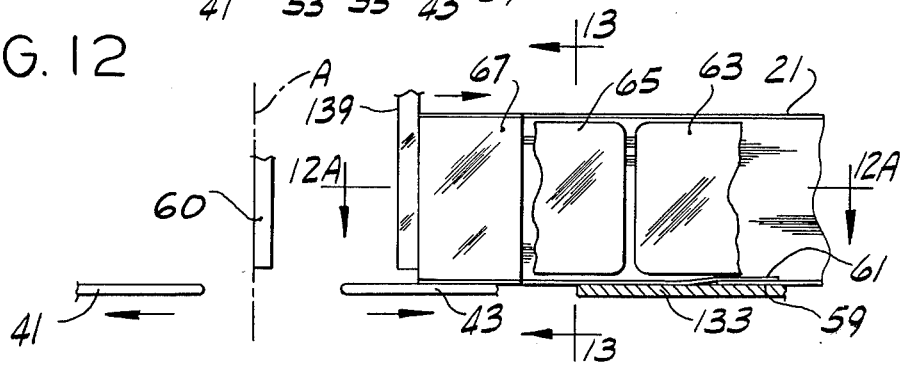
Figure 12A:
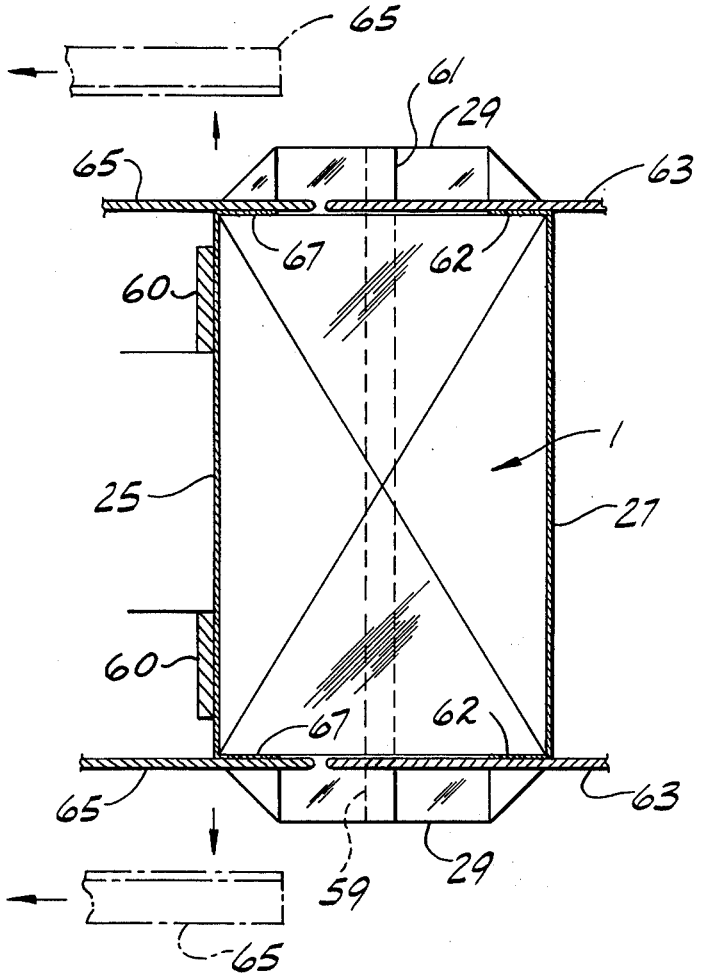
FIG. 12A is a horizontal section generally on line 12A—12A of FIG. 12 showing certain forward and rearward tuckers of the apparatus, with a showing in phantom of the rearward tuckers in a clearance position spaced outwardly from the ends of the ream.
Figure 18:
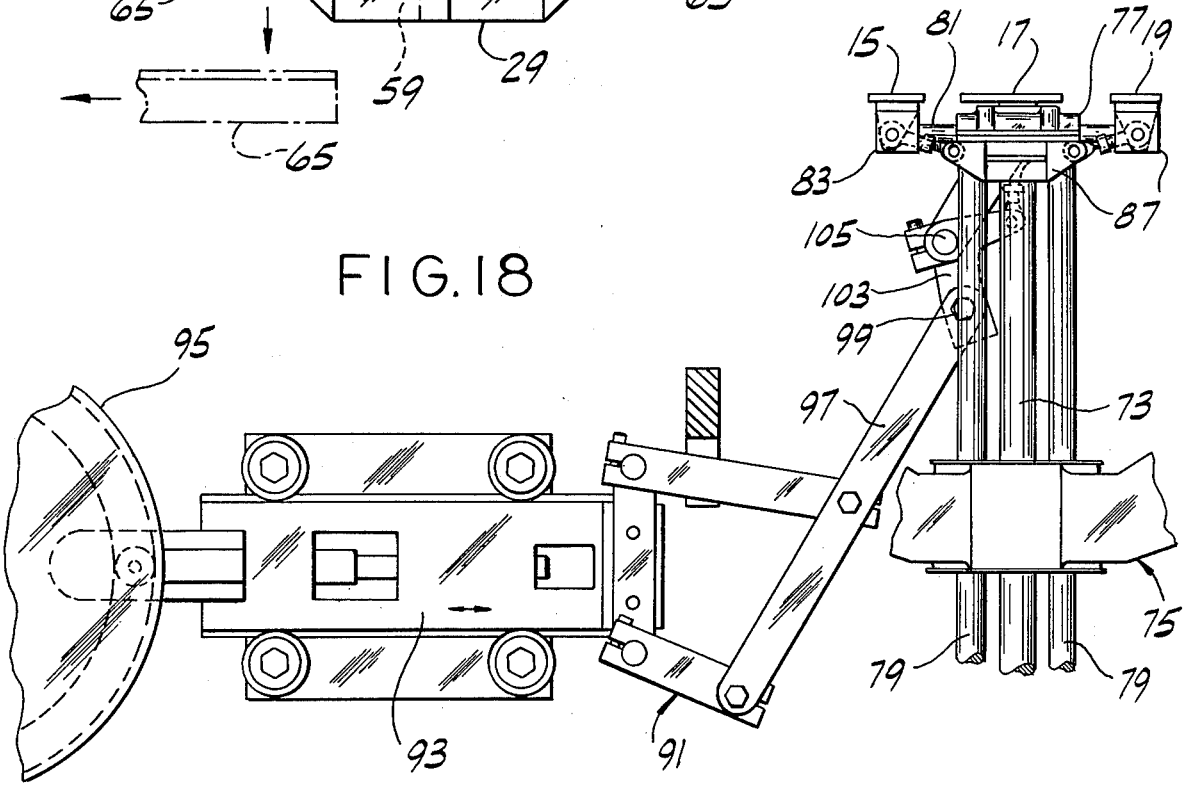
FIG. 18 is a side elevation of a cam-actuated control linkage for the elevator mechanism.

As the ream 1 is pushed forward off the underfolders 41 and 43, forward sections 62 of the end portions 29 of the wrapper extending beyond the ends 11 of the ream are folded back around the forward corners of the ream and tucked against the ends 11 of the ream by engagement with a pair of fixed forward tuckers or folding blades 63. Also, a pair of rearward tuckers or folding blades 65 is moved forward from a rearward retracted position to fold forward around the rear corners of the ream rearward sections 67 of the end portions 29 of the wrapper. These rearward tuckers 65 move forward in generally vertical position on the outside of the ends 11 of the ream to an advanced position as illustrated in FIGS. 12 and 12A to fold or tuck in said sections 67. Then they are moved outwardly away from the ends of the ream to a position as illustrated in phantom in FIGS. 12A and 13 clear of the next ream being lifted, returned rearwardly to their retracted position, and moved back inwardly to their vertical tucking or folding position for operation on the next ream raised to the upper level. Then the underfolders are returned to their retracted position for operation on the next ream.

Referring to FIGS. 14 and 16–18, the central support (or platform) 17 is shown to comprise an elongate flat bar mounted on a head 71 at the upper end of a central support rod 73 mounted for vertical sliding movement in machine frame structure such as indicated at 75. The outboard supports are carried by a head 77 on the upper ends of a pair of rods each designated 79 mounted for vertical sliding movement in the frame structure. The head 77 carries a pair of slide guide rods 81 extending laterally outwardly from both sides of the head. Each of the outboard supports (or platforms) 15 and 19 comprises an elongate flat bar on a slide 83 mounted for sliding movement for moving the outboard supports in and out relative to the central support on the guide rods 81. The central support 17 is cantilevered from the head 71 over the head 77. The slides 83 are linked as indicated at 85 to a slide actustor 87 vertically slidable on a guide 89 extending down from the head 77, and the actuator 87 is adapted to be moved up and down for moving the outboard supports 15 and 19 in and out by means of a four-bar linkage 91 on a slide 93 actuated by a cam 95, a link 97 of this four-bar linkage being pinned at 99 to a crank mechanism 101 for moving the actuator 87 up and down. This crank mechanism includes a crank 103 pivoted at 105 on the head 77. The four-bar linkage permits the assembly of the rods 79, head 77 and outboard supports 15 and 19 to move up and down for the raising and lowering of the outboard supports, and is operable by the cam 95 for the contraction, i.e., the inward movement, of the outboard supports, as they approach and reach their raised position (FIG. 3) and the expansion, i.e., the outward movement, of the outboard supports when they are lowered. The central support rod 73 is movable up and down via a linkage 107 from a cam 109 (see FIGS. 14 and 15), and the outboard support rods 79 are movable as a unit via a linkage 111 from a cam 113 (see FIG. 14).

Figure 19:
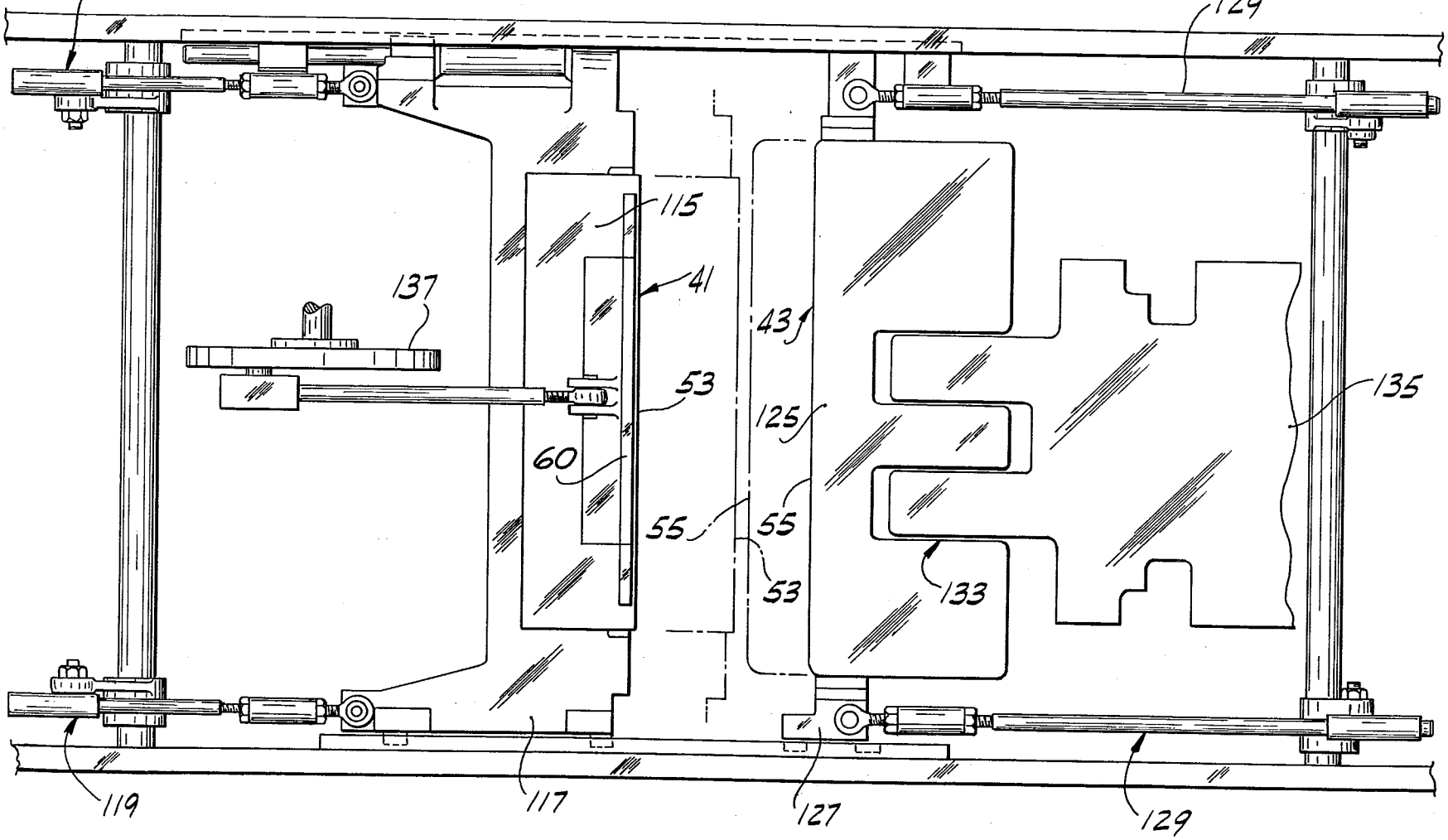
FIG. 19 is a plan of the rearward and forward underfolders of the apparatus.
Figure 20:
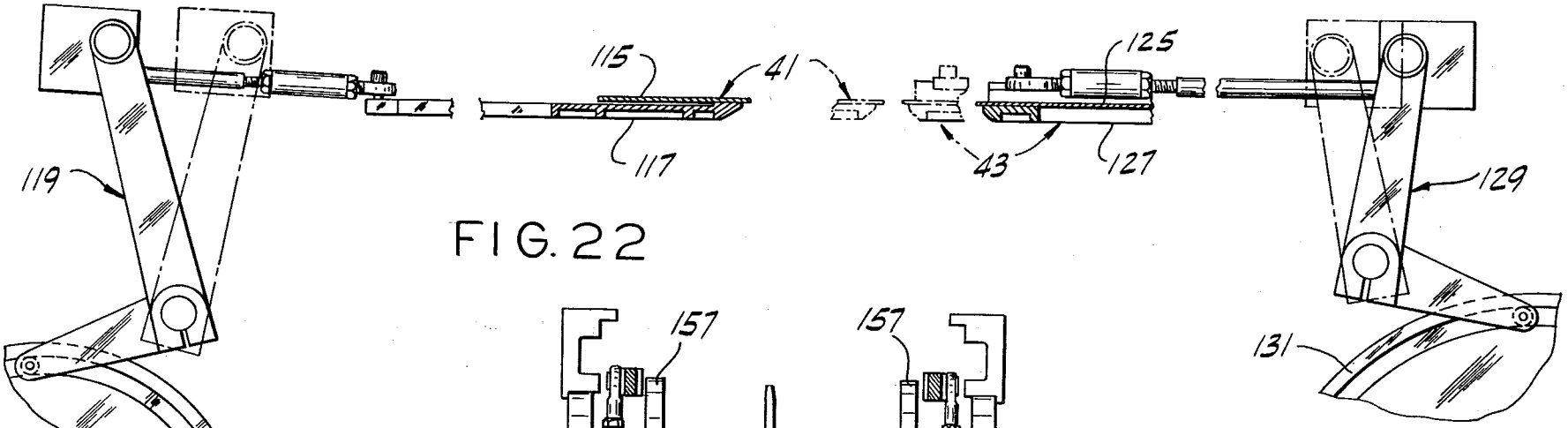
FIG. 20 is a side elevation with parts broken away and shown in section of the underfolder mechanism.

The rearward underfolder 41 comprises a plate 115 on a carriage 117 slidable forward from the retracted position in which it is shown in solid lines in FIGS. 19 and 20 to the extended (forward) position in which it is shown phantom in FIGS. 19 and 20 and back to retracted position by mechanism such as indicated at 119 including a cam 121. The forward underfolder 43 comprises a plate 125 on a carriage 127 slidable rearward from the retracted position in which it is shown in solid lines in FIGS. 19 and 20 to the extended (rearward) position in which it is shown in phantom in FIGS. 19 and 20 and back to retracted position by mechanism such as indicated at 129 including a cam 131. The rearward underfolder plate 115 extends somewhat forward from the carriage 117 and its forward end edge constitutes the rearward underfolder end edge 53. The forward underfolder plate 125 extends somewhat rearward from the carriage 127 and its rearward end edge constitutes the forward underfolder end edge 55. The forward underfolder plate 125 is interdigitated as indicated at 133 with a forward table plate 135 at the same level as the plate 125, the arrangement being such as to provide for uninterrupted bottom support of the ream as it is pushed forward off the underfolder plates 115 and 125.

The pusher 60 is suitably mounted for sliding forward from the retracted position at the rearward side of the elevated ream in which it is shown in FIGS. 1–8 for pushing the ream forward over the underfolders, and is movable forward and rearward by a cam 137. Generally, the pusher is movable forward to a point somewhat past the reference plane A where a flight 139 (see FIG. 12) of a continuously moving overhead conveyor (not shown) takes over and continues the forward movement of the ream, the pusher 59 returning to its retracted position.

Figures 13, 21:
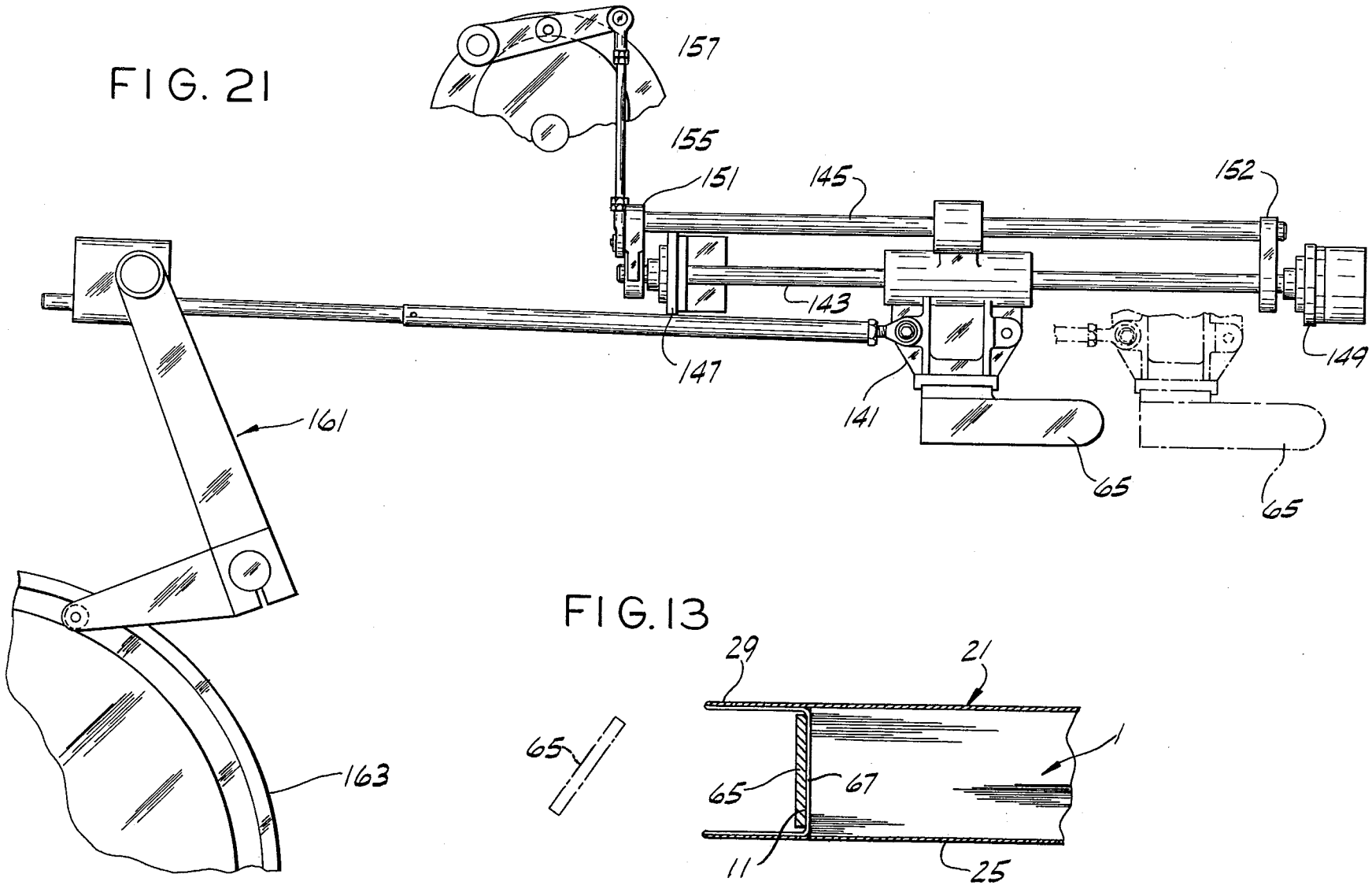
FIG. 13 is a vertical section generally on line 13—13 of FIG. 12 showing in solid lines one of the rearward tuckers in vertical tucking position on the outside of one end of the ream being wrapped and with a showing in phantom of this tucker in the clearance position.
FIG. 21 is a side elevation of a rearward tucker means of the apparatus.
Figures 14, 15:
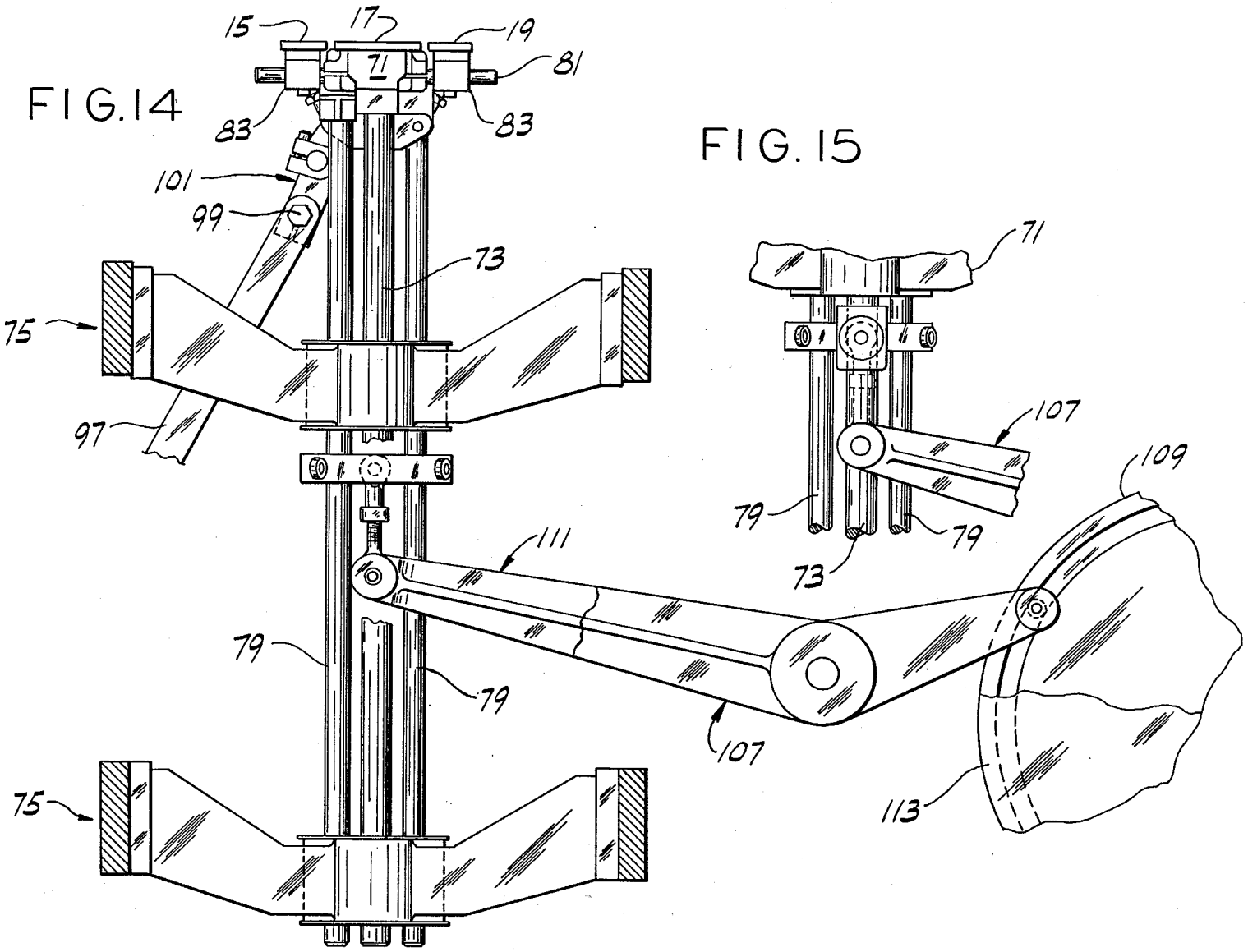
FIG. 14 is a view in side elevation of an elevator mechanism of the apparatus, parts being broken away.
FIG. 15 is a view showing parts broken away in FIG. 14.
Figure 22:
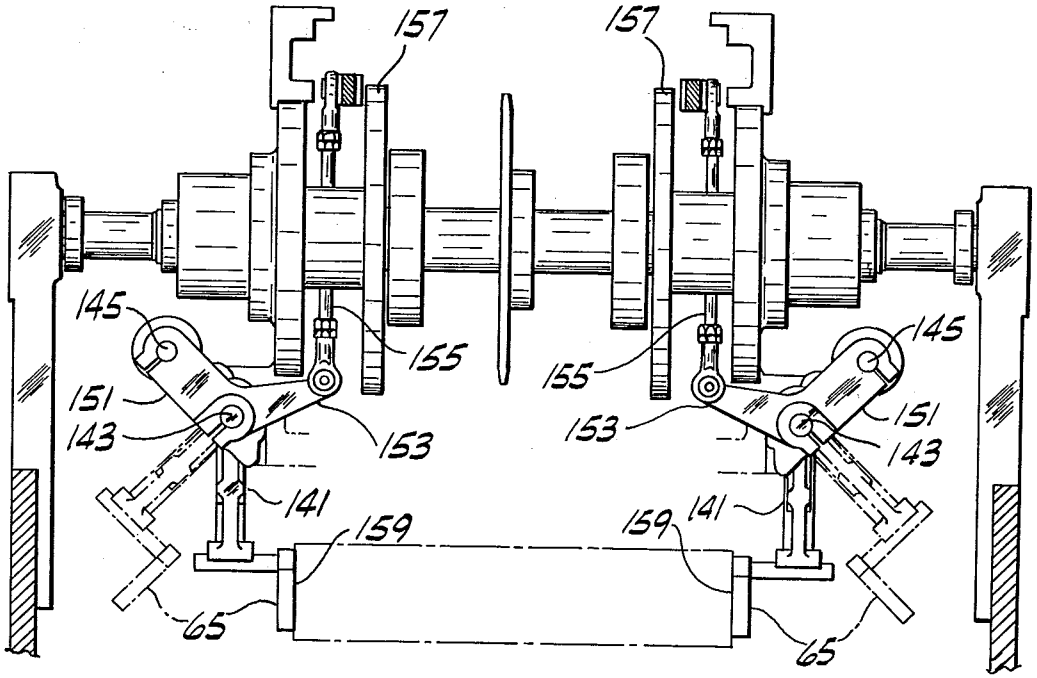
FIG. 22 is an end elevation from the left of FIG. 21.

Referring to FIGS. 21 and 22, the right-hand rearward tucker 65 (right-hand is as viewed in the direction of movement of the ream off the underfolders) is constituted by a folding blade secured to a carriage 141 slidable on a pair of guide rods 143 and 145 extending longitudinally of the apparatus at its right side. The rod 143 is mounted for rotation on its axis in bearings 147 and 149 and rod 145 extends between a pair of cranks 151 and 152 on rod 143. Crank 151 has an arm 153 operable via a link 155 from a cam 157 for swinging the cranks to swing the carriage and the tucker 65 out from the solid line position of the carriage and tucker shown in FIG. 22 wherein the tucker is in a vertical tucking position with its inside face 159 in a vertical plane just outside the right end of the ream, and the phantom position of the carriage and tucker shown in FIG. 22 wherein the tucker is clear of the next ream (and the end portions of the wrapper wrapped therearound) being lifted. The carriage 141 is slidable on the rods to move the tucker 65 forward from its retracted position of FIGS. 7–9 to its extended position of FIG. 12 (phantomed in FIG. 21) and back to retracted position by mechanism indicated at 161 including a cam 163, this mechanism being such as to permit the lateral swing of the carriage 141 and tucker. The left-hand tucker mechanism corresponds to the right.

The cams operate in unison through a single-revolution cycle and are so developed and phased as to effect the following sequence of operation:

At 0°, the central ream support 17 and the outboard ream supports 15 and 19 are down in their lowered position of FIG. 1 for the reception of a ream. They are lifted in unison to their raised position during the first 90° of rotation of cam 109 (for the central support 17) and cam 113 (for the outboard supports 15 and 19). The outboard supports 15 and 19 immediately reverse and start down, being lowered back down to the lowered position as cam 113 rotates from 90° to 175°, then dwell in the lowered position to 360°. The central support 17 dwells in the raised position (FIG. 4) during rotation of cam 109 from 90° to 120°, is lowered back down to its lowered position as cam 109 rotates from 120° to 205°, and dwells in the lowered position to 360°.

At 0°, the outboard supports 15 and 19 are in their expanded position for the reception of the ream. They dwell in their expanded position during rotation of cam 95 from 0° to 70°, are retracted as cam 95 rotates from 70° to 110°, dwell in the retracted position (and in their raised position) as cam 95 rotates from 110° to 120°, are expanded as cam 95 rotates from 120° to 170°, and dwell in their expanded position as cam 95 rotates from 170° to 360°.

The rearward underfolder 41 returns to its retracted position of FIGS. 1 and 2 as cam 121 rotates from 260° to 0° and from 0° to 10°. Thus, at 0° it is practically back to retracted position. As cam 121 rotates from 10° to 65° the rearward underfolder dwells in retracted position, from 65° to 190° it moves forward through its underfolding (forward) stroke (e.g., through $5\frac{1}{4}''$), and from 190° to 260° it dwells in its forward position.

The forward underfolder 43 returns to its retracted position of FIGS. 1 and 2 as cam 131 rotates from 285° to 0° and from 0° to 25° (at 0° it is almost back to retracted position). Then, as cam 131 rotates from 25° to 65°, the forward underfolder dwells in its retracted position, from 65° to 165° it moves rearward through its underfolding (rearward) stroke (e.g. $3\frac{1}{4}''$), and from 165° to 285° it dwells in its rearward position.

The pusher 60 returns to its retracted position of FIGS. 1–8 as cam 137 rotates from 285° to 0° and from 0° to 25° (at 0° it is almost back to its retracted position). Then, as cam 137 rotates from 25° to 145°, the pusher dwells in its retracted position, and from 145° to 285° it moves forward through its forward stroke (e.g. $4\frac{3}{4}''$).

With the cams 163 for the rearward tuckers 65 at 0°, the rearward tuckers 65 are in their forward position of FIG. 12. As the cams 163 rotate from 0° to 130° the rearward tuckers return rearward to their retracted position of FIGS. 7–9, from 130° to 170° they dwell in their rearward position, from 170° to 300° they move forward (e.g. $9\frac{1}{4}''$), and from 300° to 360° they dwell in their forward position.

It is to be understood that the particular degrees of arc and distances specified above are only exemplary, and different degrees of arc and distances may be used.

It is also to be understood that the wrapper may be prepared with a heat-reactivatable adhesive for sealing the lapping margins 59 and 61 of the wrapper together, the adhesive being reactivated in suitable manner as the wrapped ream exits off the table plate 133. It may also be prepared with similar adhesive for sealing together the top and bottom sections of the end portions 29 of the latter, these sections being suitably folded over on the ends of the ream and the adhesive reactivated as the wrapped ream exits.

With the feature of the expansible and contractable outboard supports 15 and 19, adapted in their expanded position to support the ream out to the sides of the ream, and moving inward toward the central support 17 as the underfolders 41 and 43 move inward and assume the support of the ream, and the lowering of the central support and continued inward movement of the underfolders, it is possible to wrap reams at a relatively high production rate (e.g., 80–90 per minute) without losing the integrity of the reams. In this regard, it will be understood that without such support for the ream, the edges of some of the sheets in the ream (particularly the lowermost sheets) may be bent over by the wrapper, and this edge distortion may interfere with the passage of the sheets through a copying machine. The feature of moving the rearward tuckers 65 to the clearance position on their return to retracted position after they have tucked in the end sections 67 of the wrapper on a ream is also an important feature for high speed production as it enables the next ream to be brought up during the return of the rearward tuckers and thus avoids loss of time waiting for retraction of the rearward tuckers.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of wrapping a unit such as a ream of paper, the unit having a rectangular top and bottom, rectangular sides and rectangular ends, comprising:

supporting the unit at its bottom on a central support and two outboard supports, the supports extending endwise of the unit and initially occupying a lowered position with the outboard supports in an expanded position spaced outwardly from the central support on opposite sides of the central support and with the three supports all generally flush one with another, one side of the unit constituting a rearward side and the other a forward side, the respective outboard supports constituting rearward and forward supports;

positioning a wrapper for the unit above the unit, the wrapper comprising a sheet of material larger than the top of the unit and having rearward and forward portions extending beyond the planes of the rearward and forward sides of the unit a sufficient distance for being folded down upon the rearward and forward sides of the unit and under the bottom of the unit with an overlap and end portions extending beyond the ends of the unit;

raising the supports in unison from said lowered position to a raised position to lift the unit to a raised position and, as the unit is raised, causing the rearward and forward portions of the wrapper to fold down on the rearward and forward sides of the unit;

with the unit in its raised position, moving a rear underfolder forward from a retracted position adjacent the rearward side of the unit inwardly under the bottom of the unit, moving a forward underfolder rearward from a retracted position adjacent the forward side of the unit inwardly under the bottom of the unit and, during the inward movement of said underfolders, moving the outboard supports inwardly toward the central support to clear the way for the underfolders, thereby to fold said rearward and forward portions of the wrapper in under the bottom of the unit, the unit being supported at its bottom toward the sides of the unit by said underfolders moving in under the bottom of the unit;

lowering the outboard supports back down to the lowered position, and continuing the inward movement of said underfolders into the regions vacated by the outboard supports for the underfolding of the wrapper under the unit and the support of the unit by the underfolders;

lowering the central support back down to the lowered position;

moving the unit with the wrapper wrapped therearound forward off the underfolders;

returning the underfolders to their retracted position;

returning the outboard supports to their expanded position;

and, as the unit is moved forward with the wrapper wrapped therearound, folding forward sections of said end portions back on the ends of the unit by engagement with a pair of fixed end folder, and folding rearward sections of said end portions forward on the ends of the unit by moving a pair of rearward end folders forward, independently of the forward movement of the unit, from a retracted position with said rearward end folders in a position for folding said rearward sections on the ends of the unit, then returning said rearward end folders to their retracted position while the next unit to be wrapped is being raised by moving said rearward end folders away from the ends of the unit in a first direction substantially perpendicular to the ends of the unit to a clearance position for the raising of the next unit during their return, and moving said rearward end folders rearwardly and then in a second direction substantially opposite to said first direction to their retracted and folding position for operation on the wrapper of the next unit when it has been lifted to the raised position.

2. The method of claim 1 wherein the outboard supports when in expanded position have their outer edges generally in the planes of the sides of the unit for support of the unit out to its sides.

3. The method of claim 1 wherein the movement of the underfolders under the bottom of the unit is continued into the region vacated by the central support when the central support is lowered, the underfolders then supporting the unit from the sides of the unit to the end edges of the underfolders.

4. The method of claim 3 wherein the forward underfolder is moved rearwardly under the ream a lesser distance than the rearward underfolder is moved forwardly under the ream, a margin of the said forward portion of the wrapper then projecting beyond the end edge of the forward underfolder and down between the end edges of the two underfolders.

5. The method of claim 4 wherein, as the ream with the wrapper thereon is moved forward off the underfolders, said margin of said forward portion of the wrapper is caused to lap the margin of said rearward portion of the wrapper which is folded under the bottom of the ream.

6. The method of claim 1 wherein the rearward end folders are swung in said first direction away from the ends of the unit.

7. The method of wrapping a unit such as a ream of paper to be wrapped, the unit have a rectangular top and bottom, rectangular sids and rectangular ends, comprising:

supporting the unit at its bottom on elevator means with the elevator means in a lowered position;

positioning a wrapper for the unit above the unit, the wrapper comprising a sheet of material larger than the top of the unit and having rearward and forward portions extending beyond the planes of the rearward and forward sides of the unit a sufficient distance for being folded down upon the rearward and forward sides of the unit and under the bottom of the unit and end portions extending beyond the ends of the unit;

raising the elevator means from said lowered position to a raised position to lift the unit to a raised position and, as the unit is raised, causing the rearward and forward portions of the wrapper to fold down on the rearward and forward sides of the unit;

folding said rearward and forward portions of the wrapper in under the bottom of the unit;

moving the unit with the wrapper wrapped therearound forward; and, as the unit is moved forward with the wrapper wrapped therearound, folding forward sections of said end portions back on the ends of the unit by engagement with a pair of fixed end folders, and folding rearward sections of said end portions forward on the ends of the unit by moving a pair of rearward end folders forward, independently of the forward movement of the unit, from a retracted position with said rearward end folders in a position for folding said rearward sections on the ends of the unit, then returning said rearward end folders to their retracted position while the next unit to be wrapped is being raised by moving said rearward end folders away from the ends of the unit in a first direction substantially perpendicular to the ends of the unit to a clearance position for the raising of the next unit during their return, and moving said rearward end folders rearwardly and then in a second direction substantially opposite to said first direction to their retracted and folding position for operation on the wrapper of the next unit when it has been lifted to the raised position.

8. The method of claim 7 wherein the rearward end folders are swung in said first direction away from the ends of the unit.

9. Apparatus for wrapping a unit such as a ream of paper to be wrapped, the unit having a rectangular top and bottom, rectangular sides and rectangular ends, comprising:

a central support and two outboard supports for supporting the unit at its bottom, the supports extending endwise of the unit, said central support being movable up and down, said outboard supports being movable up together with the cental support and down independently of the central support, being at opposite sides of the central support and being laterally movable inwardly from an expanded position spaced outwardly from the central support, said supports initially occupying a lowered position with the outboard supports in their expanded position and with the three supports all generally flush one with another, one side of the unit constituting a rearward side and the other a forward side, the respective outboard supports constituting rearward and forward supports;

means for positioning a wrapper for the unit above the unit, the wrapper comprising a sheet of material larger than the top of the unit and having rearward and forward portions extending beyond the planes of the rearward and forward sides of the unit a sufficient distance for being folded down upon the rearward and forward sides of the unit and under the bottom of the unit and end portions extending beyond the ends of the unit;

elevator means for raising and lowering the central and outboard supports, said elevator means being operable to raise the supports in unison from said lowered position to a raised position to lift the unit to a raised position;

means engageable with the wrapper as the unit is raised for causing the rearward and forward portions of the wrapper to fold down on the rearward and forward sides of the unit;

a rear underfolder movable forward from a retracted position adjacent the rearward side of the unit inwardly under the bottom of the raised unit, a forward underfolder movable rearward from a retracted position adjacent the forward side of the unit inwardly under the bottom of the raised unit; means for moving the underfolders; and means for moving the outboard supports inwardly toward the central support during the inward movement of said underfolders to clear the way for the underfolders, thereby to fold said rearward and forward portions of the wrapper in under the bottom of the unit, the unit being supported at its bottom toward the sides of the unit by said underfolders moving in under the bottom of the unit;

said elevator means having means for lowering the outboard supports back down to the lowered position independently of the central support; said means for moving the underfolders continuing their inward movement into the regions vacated by the outboard supports for the underfolding of the wrapper under the unit and the support of the unit by the underfolders;

said elevator means having means for lowering the central support back down to the lowered position;

and means for moving the unit with the wrapper wrapped therearound forward off the underfolders;

the means for moving the underfolders being operable to move the underfolders back to their retracted position;

the means for moving the outboard supports being operable to move the outboard supports back to their expanded position;

a pair of fixed end folders for folding back forward sections of said end portions on the ends of the unit as the unit is moved forward with the wrapper wrapped therearound;

a pair of rearward end folders for folding forward rearward sections of said end portions on the ends of the unit, means for moving said rearward end folders independently of said means for moving the unit forward from a retracted position while in a position for folding said rearward sections on the ends of the unit to fold said rearward end sections and for moving said rearward end folders rearward to their retracted positon, said rearward end folders being returned to their retracted position while the next unit to be wrapped is being raised;

and means for moving said rearward end folders away from the ends of the unit in a first direction substantially perpendicular to the ends of the unit to a clearance position for the raising of the next unit during their return, and for moving said rearward end folers in a second direction substantially opposite to said first direction to their retracted and folding position after the rearward movement of said rearward end folders for operation on the wrapper of the next unit when it has been lifted to the raised position.

10. Apparatus as set forth in claim 9 wherein the means for moving the outboard supports, in moving them to expanded position, brings them to have their outer edges generally in the planes of the sides of the unit for support of the unit out to its sides.

11. Apparatus as set forth in claim 10 wherein the means for moving the underfolders is operable to continue their movement into the region vacated by the central support when the central support is lowered, the underfolders then supporting the unit from the sides of the unit to the end edges of the underfolders.

12. Apparatus as set forth in claim 11 wherein the means for moving the underfolders is operable to move the forward underfolder rearwardly under the ream a lesser distance then the rearward underfolder is moved forwardly under the ream, a margin of the said forward portion of the wrapper then projecting beyond the end edge of the forward underfolder and down between the end edges of the two underfolders.

13. Apparatus as set forth in claim 9 wherein the means for moving the rearward end folders in said first direction swings them in said first direction.

14. Apparatus for wrapping a unit such as a ream of paper to be wrapped, the unit having a rectangular top and bottom, rectangular sides and rectangular ends, comprising:

elevator means for supporting the unit at its bottom;

means for raising and lowering the elevator means, said elevator means being operable to raise a unit from a lowered position to a raised position;

means for positioning a wrapper for the unit above the unit, the wrapper comprising a sheet of material larger than the top of the unit and having rearward and forward portions extending beyond the planes of the rearward and forward sides of the unit a sufficient distance for being folded down upon the rearward and forward sides of the unit and under the bottom of the unit and end portions extending beyond the ends of the unit;

means engageable with the wrapper as the unit is raised for causing the rearward and forward portions of the wrapper to fold down on the rearward and forward sides of the unit;

means for folding said rearward and forward portions of the wrapper in under the bottom of the unit;

means for moving the unit with the wrapper wrapped therearound forward off the underfolders;

a pair of fixed end folders for folding back forward sections of said end portions on the ends of the unit as the unit is moved forward with the wrapper wrapped therearound;

a pair of rearward end folders for folding forward rearward sections of said end portions on the ends of the unit, means for moving said rearward end folders independently of said means for moving the unit forward from a retracted position while in a position for folding said rearward sections on the ends of the unit to fold said rearward end sections and for moving said rearward end folders rearward to their retracted position, said rearward end folders then being returned to their retracted position while the next unit to be wrapped is being raised;

and means for moving said rearward end folders away from the ends of the unit in a first direction substantially perpendicular to the ends of the unit to a clearance position for the raising of the next unit during their return, and for moving said rearward end folders in a second direction substantially opposite to said first direction to their retracted and folding position after the rearward movement of said rearward end folders for operation on the wrapper of the next unit when it has been lifted to he raised position.

15. Apparatus as set forth in claim 14 wherein the means for moving the rearward end folders in said first direction swings them in said first direction.

* * * * *